United States Patent [19]

Coquillart

[11] 4,439,913

[45] Apr. 3, 1984

[54] METHOD AND MEANS FOR MANUFACTURING FRONTAL COMMUTATORS OF ELECTRIC MOTORS, MORE PARTICULARLY OF THE TYPE HAVING AN INSULATION BETWEEN THE COMMUTATOR BARS

[75] Inventor: Michel Coquillart, St. Etienne Terrenoire, France

[73] Assignee: Mavilor Systemes, Switzerland

[21] Appl. No.: 261,697

[22] Filed: May 8, 1981

[30] Foreign Application Priority Data

May 9, 1980 [FR] France ..... 80 11151

[51] Int. Cl.[3] ..... H01R 43/08

[52] U.S. Cl. ..... 29/597; 29/418; 310/237

[58] Field of Search ..... 29/597, 418; 310/233, 310/237

[56] References Cited

U.S. PATENT DOCUMENTS

| | | | |
|---|---|---|---|
| 2,202,820 | 8/1933 | Baird et al. . | |
| 3,293,694 | 12/1966 | Taylor, Jr. | 29/597 X |

FOREIGN PATENT DOCUMENTS

| | | |
|---|---|---|
| 381719 | 9/1923 | Fed. Rep. of Germany . |
| 458088 | 10/1913 | France . |
| 2215722 | 7/1973 | France . |
| 2171540 | 9/1973 | France . |
| 693914 | 7/1953 | United Kingdom . |

*Primary Examiner*—Carl E. Hall

*Attorney, Agent, or Firm*—Eric P. Schellin

[57] ABSTRACT

A method of manufacturing frontal commutators including placing mica sheets in precut grooves of a commutator blank and contacting the blank to retain the mica sheets in place.

7 Claims, 8 Drawing Figures

METHOD AND MEANS FOR MANUFACTURING FRONTAL COMMUTATORS OF ELECTRIC MOTORS, MORE PARTICULARLY OF THE TYPE HAVING AN INSULATION BETWEEN THE COMMUTATOR BARS

The invention relates to a method and means for manufacturing frontal commutators of electric motors, more particularly of the type having insulation between the commutator bars.

The object of the invention belongs to the technical field of the electric motors, and more particularly to the technical field of electric motor commutators.

The manufacture of the cylindrical commutators of electric motors having mica insulation within the grooves provided at the periphery, is well known.

The manufacture of the frontal collectors, or of disk-shaped commutators, of the same kind, i.e. with a mica intersegmental insulation, has not been heretofore solved in a satisfactory manner.

The method and means in accordance with the invention obviate the difficulties resulting from these problems of manufacture in that the rational and economical production of frontal commutators with a mica intersegmental insulation is made possible with a good accuracy and with simplified tools.

In accordance with a first characteristic, the commutator is cut to length, the various necessary diameters are machined, a plurality of radial grooves is made on a face of the crown which has been thus produced in which insulating sheets are inserted the profile of which corresponds to the sectional profile of the commutator but with slightly different dimensions, the commutator is forced through the bore of slight taper of a tooling in order to hold securely the sheets within the grooves by diametral contraction of the commutator, the thin portions of the commutator which are situated between the radial grooves and the face of the commutator opposite to the grooves are removed by machining in a second tooling, the commutator thus prepared is placed between the two parts of a mold in which the resin for encasing the commutator equipped with its windings and the socket is cast.

These and other characteristics will be apparent from the following description.

To make the object of the invention more clearly understood, without however limiting it, in the attached drawings.

In order to make the object of the invention more readily apparent, this object will be described now with reference to the forms of embodiment illustrated in the Figures of the drawings, without being restricted thereby.

The commutators in accordance with the invention are cut to length from a copper stock or tube by saw cutting or equivalent means.

Each disk obtained is machined in any known manner to constitute a rough commutator 1 having a profile which corresponds in section to the definition thereof or to the characteristics of use.

In the example illustrated, the commutator has a sectional shape including two annular bearing parts 1*a*–1*b* of different diameters with a groove 1*c* of rectangular section on the inside and a groove 1*d* on the outside for connection between the two bearing parts.

Figure 1:
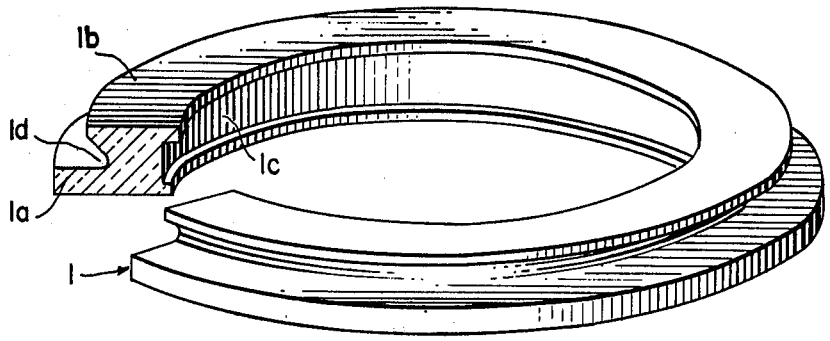
FIG. 1 is a perspective view illustrating a rough machined commutator, in accordance with a non-restrictive form of embodiment.
Figure 2:
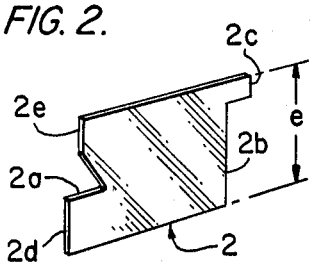
FIG. 2 is a perspective view illustrating a segment of mica having a section which corresponds approximately to the section of the commutator according to FIG. 1.
Figure 3:
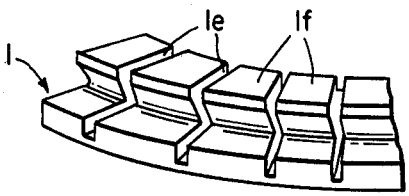
FIG. 3 is a perspective view in part, illustrating the commutator after the radial grooves have been made.

With a saw-mill or a similar tool, the grooves 1*e* (FIG. 3) are made radially from the bearing part 1*b*, the depth a of these grooves being slightly less than the thickness b of the commutator (FIG. 4), so that the segments 1*f* constituted by the areas between the grooves will be maintained in cooperation with one another.

Figure 4:
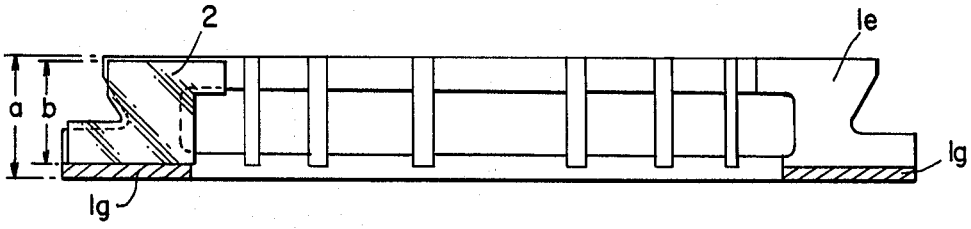
FIG. 4 is a sectional view illustrating a segment of mica positioned within a groove of the commutator.

Sheets of mica or other insulating material 2, having a thickness which is approximately equal to the width of the grooves 1*e*, are cut out along a profile of the same nature as the sectional profile of the commutator, but with a height c which is slightly less or equal to the depth a of the grooves, with faces 2*a*-2*b*-2*c* extending beyond the sectional profile of the commutator when the sheets are disposed within the grooves, and conversely with faces 2*d*-2*e* which are recessed relative to the sectional profile of the commutator (FIG. 4).

Figure 5:
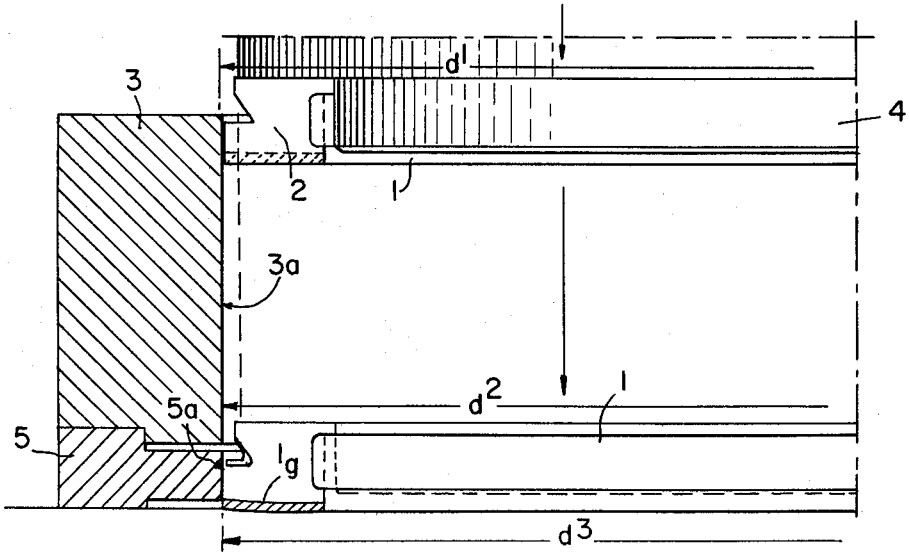
FIGS. 5 to 8 are views of a diagrammatical nature, illustrating the other operational steps of the method in accordance with the invention.
Figure 6:
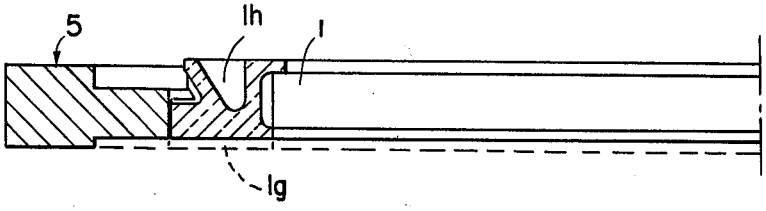

With the sheets of mica 2 engaged and positioned within the grooves 1*e*, it is necessary now for these sheets to be retained securely within the grooves. For this, it is necessary to tighten the segments 1*f*. For this purpose, the commutator equipped with its sheets of mica is placed at the inlet of a bore 3*a* of slight taper formed within a tooling 3, the larger diameter d1 of which corresponds approximately to the diameter of the commutator, the smaller diameter d2 being less than the diameter of the commutator (FIG. 5). With the aid of a chuck or mandrel 4 or the like, which may be actuated by any means, the commutator 1 is forced downward to the level of the smaller diameter d2 of the bore 3*a*, and this has the effect to decrease the diameter of the commutator and to tighten further the segments 1*f* which clamp firmly by diametral contraction the sheets of mica 2 which are also compressed at the upper part thereof by the chuck or mandrel 4, while the thin portions 1*g* of the commutator situated beneath the grooves 1*e* are distorted under the stress they are subjected to (FIG. 5).

A second tooling 5 is placed beneath the tooling 3. This tooling has a bore 5*a* the diameter d3 of which is equal to the diameter d2 of the bore 3*a*. On completion of the travel of the chuck or mandrel 4, the commutator is completely and firmly engaged within the tooling 5 (dotted lines, FIG. 5).

The tooling 5 with its commutator is then positioned on a machining lathe in order to make for instance a groove 1*h* on the bearing part 1*b* of the commutator and to straighten the opposite face of the commutator up to the removal of the distorted portions 1*g*.

Figure 7:
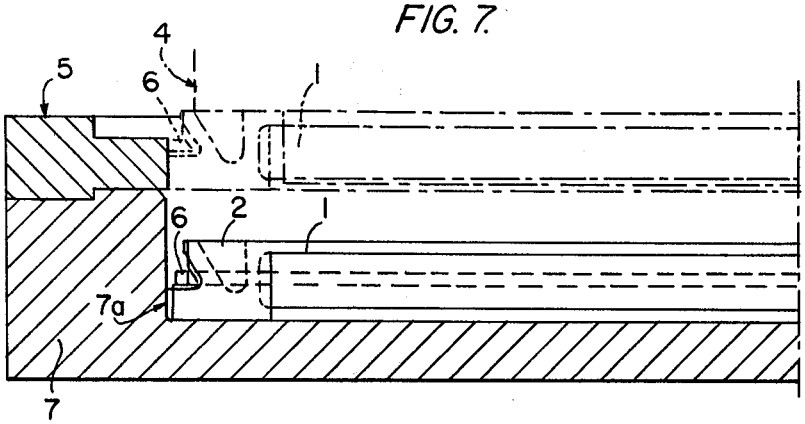

When this machining operation is completed, a metal ring 6 for reinforcing the commutator is for instance positioned within the outer groove 1*d* where the ring is resting on the protruding face 2*a* of the sheets of mica, without any contact with the commutator and therefore without electrical connection (FIG. 7).

The tooling 5 with its commutator is then centered above the bore *7a* of a third tooling 7 which is in fact the lower part of the mold in which the commutator is to be encased in resin, and which includes for this purpose a blind bore *7a* for receiving the commutator 1 discharged from the tooling 5 by the thrust of the chuck or mandrel 4 or like organ (FIG. 7).

Figure 8:
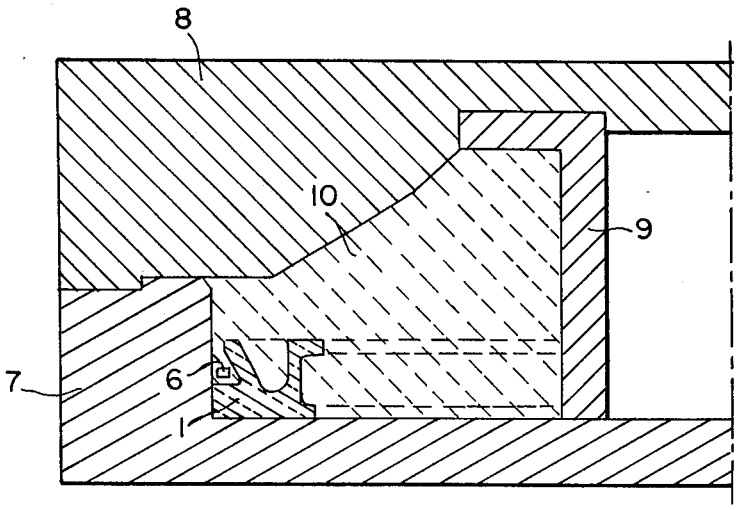

All that remains to be done now is to position the upper part 8 of the mold with the inner socket 9 of the commutator and to cast the resin 10 which is to form the centre of the rotor (FIG. 8) the periphery of which, equipped in a known manner with its windings connected with the segments of the commutator, is then formed also by encasing within the resin, in a further mold.

Many alternative forms of embodiment are of course possible within the scope of the invention. For instance, the groove 1*h* may be made prior to making the grooves 1*e* (for example after cutting up), or this groove 1*h* may be of a different shape, or also the commutator may not have this groove 1*h*. Likewise, the reinforcement ring 6 may be omitted or disposed within the groove 1*h* or positioned prior to or after positioning the commutator within the lower part 7 of the mold.

The advantages are clearly apparent from the description, and the following is more particularly pointed out: the rational and economical manufacture of frontal commutators with intersegmental insulation of mica, by means of toolings which are simple and can be re-used many times together with a good accuracy and a high reliability.

The invention is not limited in any way to the details of use and of design of its various elements which have been more particularly shown herein; on the contrary, all the alternative forms of embodiment are included within the scope of the invention.

I claim:

1. Method for manufacturing frontal commutators of electric motors, more particularly of the type having insulation between the commutator bars, characterized in that the commutator (1) is cut to length, the various necessary diameters are machined, a plurality of radial grooves (1*e*) are made on a face of a crown thus obtained and in which grooves insulating sheets (2) the profiles of which correspond to the sectional profile of the commutator but with slightly different dimensions, are inserted, the commutator is forced through a bore (3*a*) of slight taper of a tooling (3) to retain securely the sheets (2) within the grooves (1*e*) by diametral contraction of the commutator, thin portions (1*g*) of the commutator which are situated between the radial grooves and the face of the commutator opposite to the grooves are removed by machining within a second tooling (5), the commutator thus prepared is placed between two parts (7-8) of a mold in which resin (10) for encasing the commutator equipped with its windings and the inner socket (9) is cast.

2. Method as claimed in claim 1, characterized in that the radial grooves (1*e*) are made with the aid of a saw and to a depth which is slightly less than the thickness of the commutator (1) so that the segments (1*f*) constituted by the areas between the grooves will be retained between said grooves.

3. Method as claimed in claim 1, characterized in that the insulating sheets (2) of mica for example, are cut out along a profile which is such that the lateral faces (2*a*-2*b*-2*c*) thereof will be protruding relative to the sectional profile of the commutator, while the upper face and the lateral faces (2*d*-2*e*) thereof will be recessed, this being so when the sheets (2) are placed within the grooves (1*e*).

4. Method as claimed in claim 1, characterized in that the commutator (1) equipped with its insulating sheets (2) is placed at the inlet of a bore (3*a*) of the tooling (3) the larger diameter (d1) of which corresponds approximately to the diameter of the commutator, the commutator is urged by a chuck or mandrel (4) toward the lower diameter (d2) of the bore which is smaller than the diameter (d1), so that the segments (1*f*) of the commutator will be clamped against the insulating sheets (2) by diametral contraction.

5. Method as claimed in claim 4, characterized in that the commutator, on completion of the travel of the chuck or mandrel (4) is completely engaged and retained within the second tooling (5) placed under the tooling (3) the bore of which has a diameter (d3) equal to the diameter (d2) of the tooling (3), the tooling (5) and the commutator (1) being then positioned on a machining lathe in order to straighten the face of the commutator (1) situated beneath the grooves (1*e*) up to the removal of the thin portions (1*g*) and as the case may be to effect other machinings such as a groove (1*h*) on the side of the grooves (1*e*).

6. Method as claimed in claim 5, characterized in that the tooling (5) and the commutator (1) thus produced are centered above the bore (7*a*) of a tooling (7) forming the lower part of a mold, the commutator being discharged from the tooling (5) by the chuck or mandrel (4).

7. Method as claimed in claim 6, characterized in that the commutator (1) receives a reinforcement ring (6) which is so disposed as to rest on the protruding face (2*a*) of the insulating sheets (2), without any electrical connection or contact with the commutator.

* * * * *